United States Patent [19]

Johnson

[11] Patent Number: 4,549,365

[45] Date of Patent: Oct. 29, 1985

[54] SNOW REMOVING ATTACHMENT FOR AUTOMOTIVE VEHICLES

[76] Inventor: Donald L. Johnson, 2303 Avenue B, Billings, Mont. 59102

[21] Appl. No.: 597,128

[22] Filed: Apr. 5, 1984

[51] Int. Cl.[4] ..... E01H 5/09

[52] U.S. Cl. ..... 37/251; 37/260; 192/0.049; 192/13 R

[58] Field of Search ..... 37/244, 248, 249, 250, 37/251, 260, 261; 192/13 R, 13 A, 0.049, 3.51

[56] References Cited

U.S. PATENT DOCUMENTS

| | | | |
|---|---|---|---|
| 2,692,445 | 10/1954 | Darnell | 37/251 |
| 2,777,217 | 1/1957 | Klauer | 37/250 |
| 3,115,714 | 12/1963 | Johann | 37/251 |
| 3,252,233 | 5/1966 | Simi | 37/252 |
| 3,272,030 | 9/1966 | Blozis | 37/251 |
| 3,309,798 | 3/1967 | Devlin et al. | 37/244 X |
| 3,334,429 | 8/1967 | Price | 37/260 |
| 3,808,715 | 5/1974 | Haban | 37/260 |
| 3,938,400 | 2/1976 | Konyha | 37/244 |
| 4,068,397 | 1/1978 | Bacon | 37/260 |
| 4,255,879 | 3/1981 | Greider | 37/260 |

*Primary Examiner*—E. H. Eickholt

*Attorney, Agent, or Firm*—Herbert C. Schulze

[57] ABSTRACT

This invention is a new and unique snow removing apparatus to be fastened upon automotive vehicles, particularly relatively light weight vehicles such as pickup trucks and the like. The invention is characterized by a unique rotary snow pickup mechanism and throwing device together with a non clogging unique design discharge arrangement and wherein the apparatus is powered independently from the vehicle. Instantly removable attachment means and easily controllable height adjustment means are provided in cooperative relationship.

1 Claim, 17 Drawing Figures

FIG. 11.
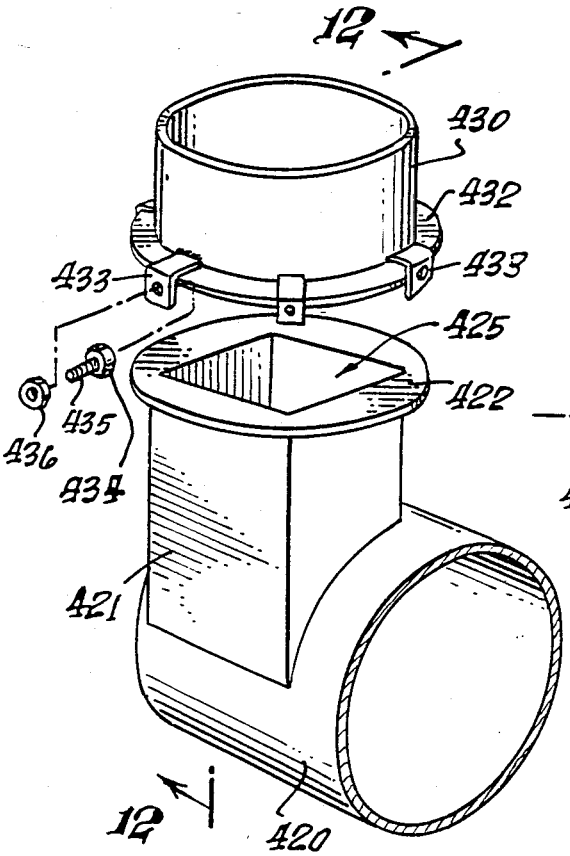
FIG. 12.
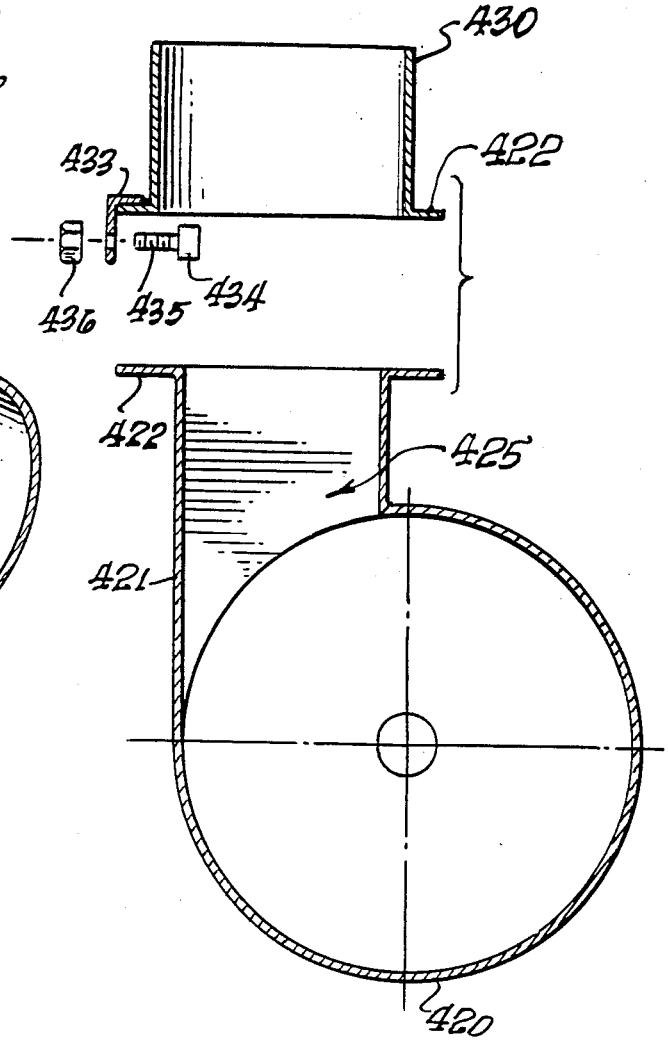
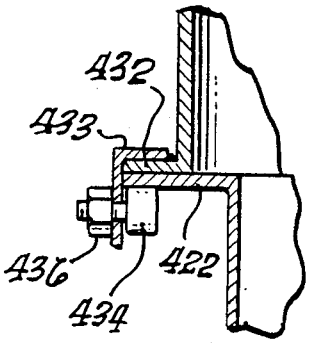
FIG. 13.

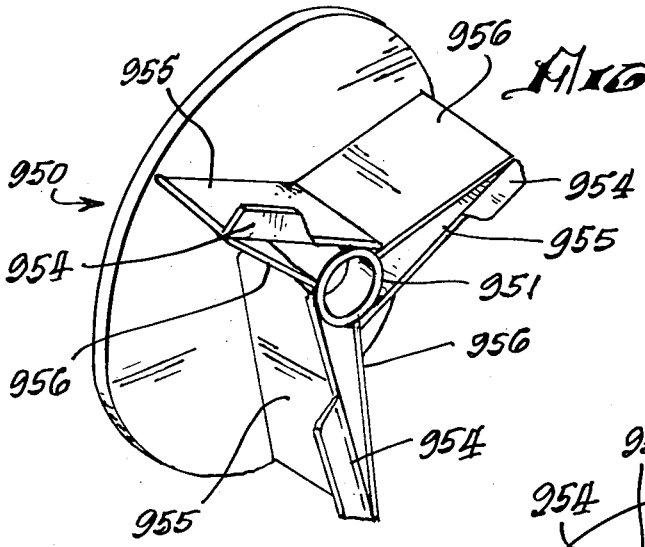
FIG. 14.
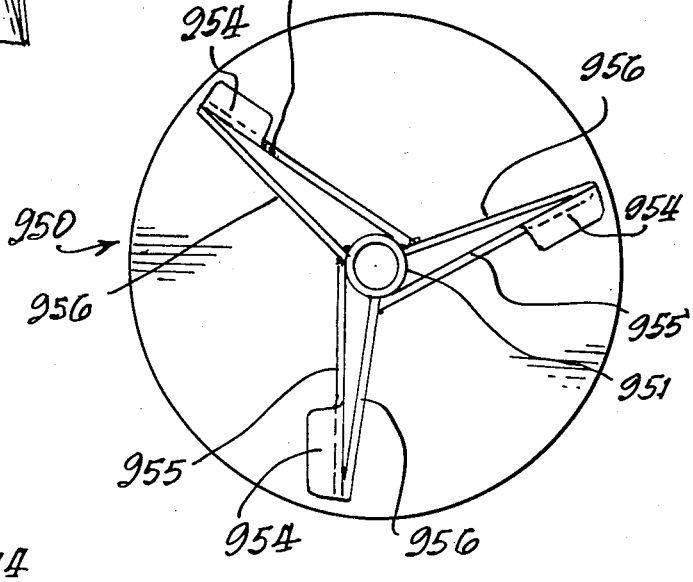
FIG. 15.
FIG. 16.
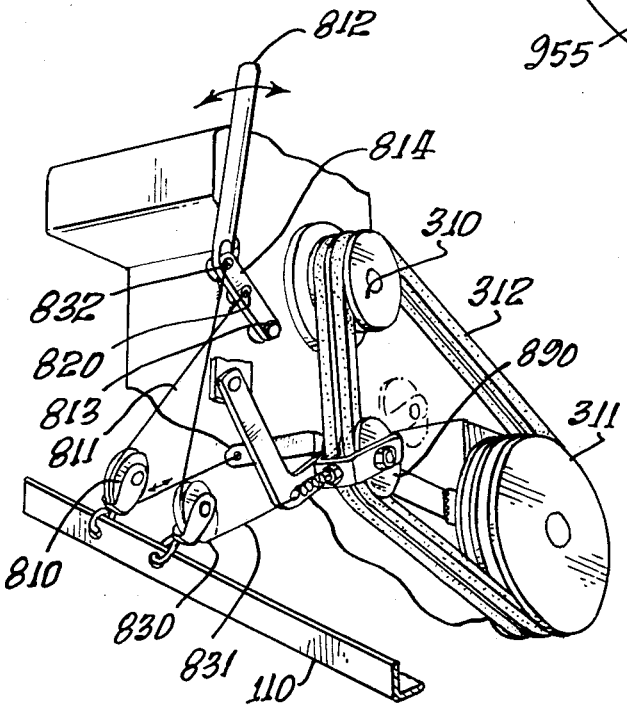
FIG. 17.
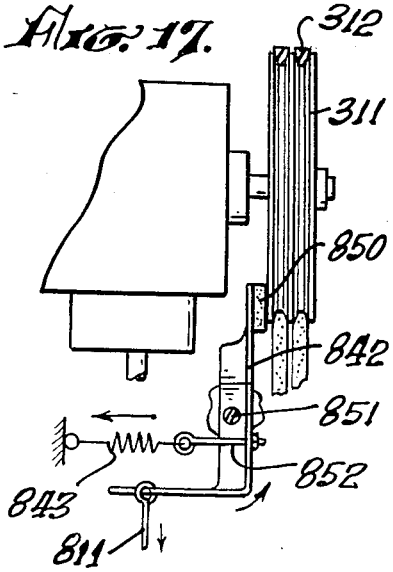

SNOW REMOVING ATTACHMENT FOR AUTOMOTIVE VEHICLES

CROSS REFERENCE TO RELATED PATENT APPLICATIONS

This apparatus is unrelated to any other patent applications filed by me.

BACKGROUND OF THE INVENTION

I. Field of the Invention

This invention is in the general field of snow removal apparatus and is more particularly directed to snow removal apparatus carried by an automotive vehicle. The invention is even more particularly directed to a snow removal apparatus detachably mountable upon light automotive vehicles such as pickup trucks and the like, and is even more particularly directed to such an apparatus wherein rotating members pick up and expell snow through a directionally adjustable discharge chute, and even more particularly directed to such an apparatus wherein the snow removal apparatus is independently powered.

II. Description of the Prior Art

There are many different snow removal devices which have been available in the past, including snow throwing devices which may be pushed or carried under power on their own wheels, major snow throwing apparatus mounted upon trucks and the like, and snow scrapping devices such as bulldozers and the like. For use on pickup trucks and the like, the prior art is limited to various bulldozer type blades generally mounted in the front of a pickup truck or the like and utilized to push the snow from roads or the like utilizing the pushing power of the pickup truck itself.

Snow throwing type devices have not been generally available for such use and particularly snow throwing devices which are capable of operating independently of the speed or power of the vehicle itself are unknown for use on pickup trucks. My invention for the first time incorporates the features of non clogging discharge arrangement and self power, mountable upon a pickup truck or the like, and thus, until my recent invention thereof, there has been no prior art of this nature.

SUMMARY OF THE INVENTION

There are many places throughout the world in which heavy snowfall occurs at various times of the year. In such places, the removal of snow from roads, driveways, and the like is an extremely important function in order to allow for movement of vehicles, particularly automobiles and the like.

Many areas wherein there is heavy snowfall will be provided with heavy removal equipment by local governmental agencies. Also some contractors provide heavy snow removal for private areas.

However, in many areas there is no satisfactory and economical way to remove snow from driveways other than by some type of attachment to relatively light vehicles such as pickup trucks and the like.

It is common to utilize pickup trucks for pushing a bulldozer like blade or the like and thus to remove snow by brute force in this manner. Such method of snow removal, however, is very hard on vehicles and puts an extremely heavy load on vehicles.

There are some light weight snow blowers in use, these being adaptable to clear very small areas only.

The power from an automotive vehicle is generally speaking not sufficient to properly utilize any type of snow thrower since the necessity of vehicle movement with the snow throwing is just too much for such vehicles. Additionally the design of any such snow thrower in the past has not been conducive to effective clearing of snow in this manner.

I have studied the problem of snow removal at considerable length and have now conceived and developed a superior and unique apparatus to be attached to pickup trucks and the like for economical and efficient snow removal from areas not properly serviced or serviceable by major snow removal equipment.

I have accomplished my purpose by specially designing a rotary snow pickup mechanism having unique snow pickup characteristics and unique snow throwing paddles. These paddles throw snow through a discharge chute of special design which will not clog as is common with most small snow discharge chutes. A special configureation as is described in detail in the description of a preferred embodiment which follows, provides this unusual characteristic.

Also, I have independently powered this apparatus so that there is no loss of power by being operated by a vehicle engine, and at the same time no harmful overload of the pickup truck of the like is encountered.

It is an object of this invention to provide a new and unique snow thrower type snow removal apparatus to be carried by light vehicles such as pickups and the like;

Another object of this invention is to provide such an apparatus as described wherein there will be no unusual power load applied to the pickup truck or the like utilizing my new invention;

Another object of this invention is to provide such a snow removal apparatus as described in which there is no clogging of the snow discharge chute by the snow passing into and through it.

The foregoing and other objects and advantages of this invention will become apparent to those skilled in the art upon reading the description of a preferred embodiment which follows, in conjuction with a review of the appended drawings.

BRIEF DESCRIPTION OF THE DRAWINGS

FIG. 11 is a partially exploded view of the snow removal mechanism of this apparatus;

FIG. 12 is an enlarged section on 12—12 of FIG. 11;

FIG. 13 is a partial section of a portion of the elements shown in FIGS. 11 and 12 in its assembled form to show the operation thereof;

FIG. 14 is a perspective of an alternate embodiment of element 450 shown in FIG. 5;

FIG. 15 is a front elevational of the element of FIG. 14;

FIG. 16 is a schematic perspective showing a clutch and brake mechanism used in connection with the independent power source for this device; and FIG. 17 is a partial elevational view showing the apparatus and the means by which brake pressure is applied to the mechanism when the clutch is disengaged.

DESCRIPTION OF A PREFERRED EMBODIMENT

Figure 1:
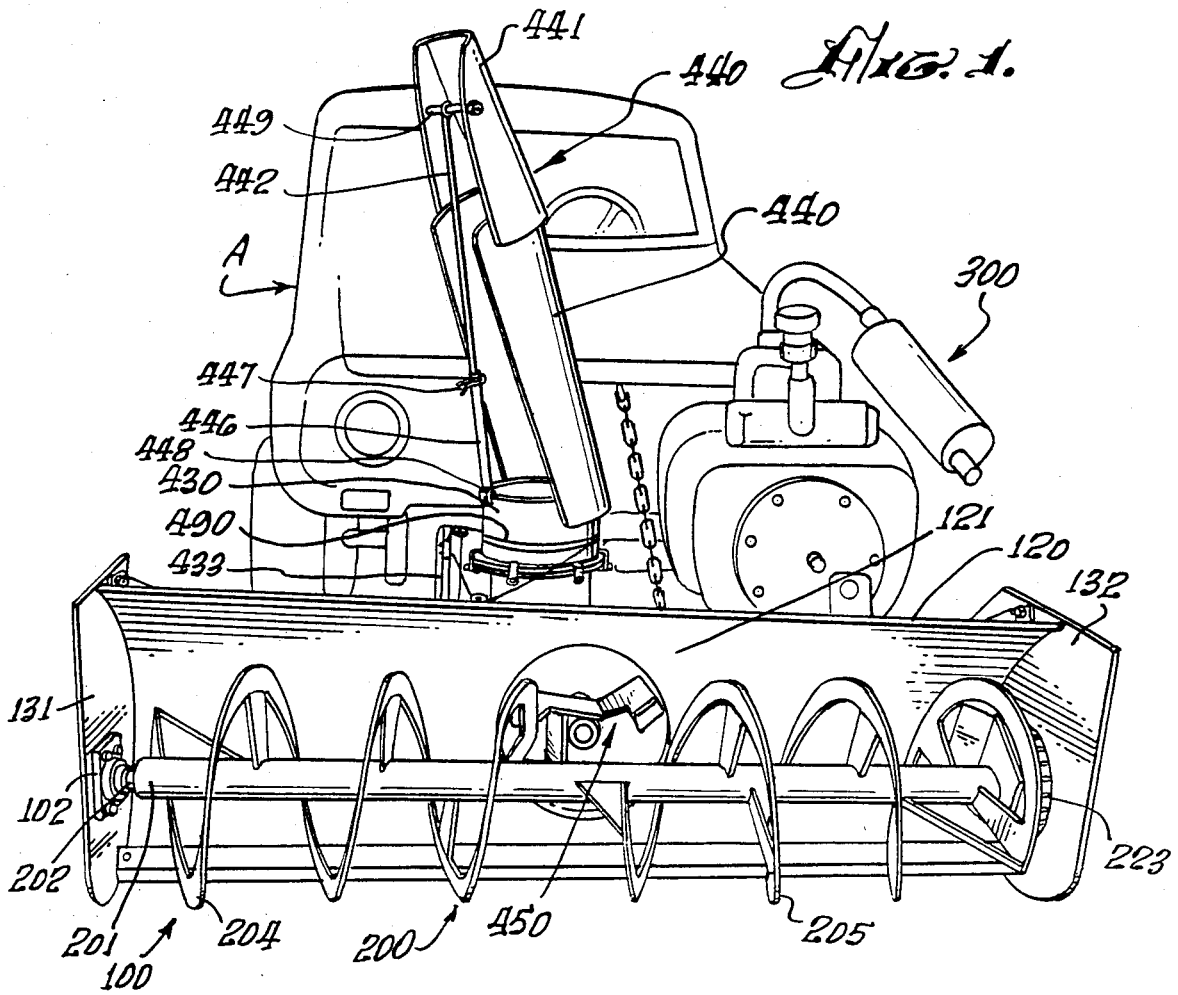
FIG. 1 is a schematic isometric view from the front of a preferred embodiment of this invention.

FIG. 1 shows an automotive vehicle such as a pickup truck A having attached to it a preferred apparatus of this invention generally 100.

Figure 2:
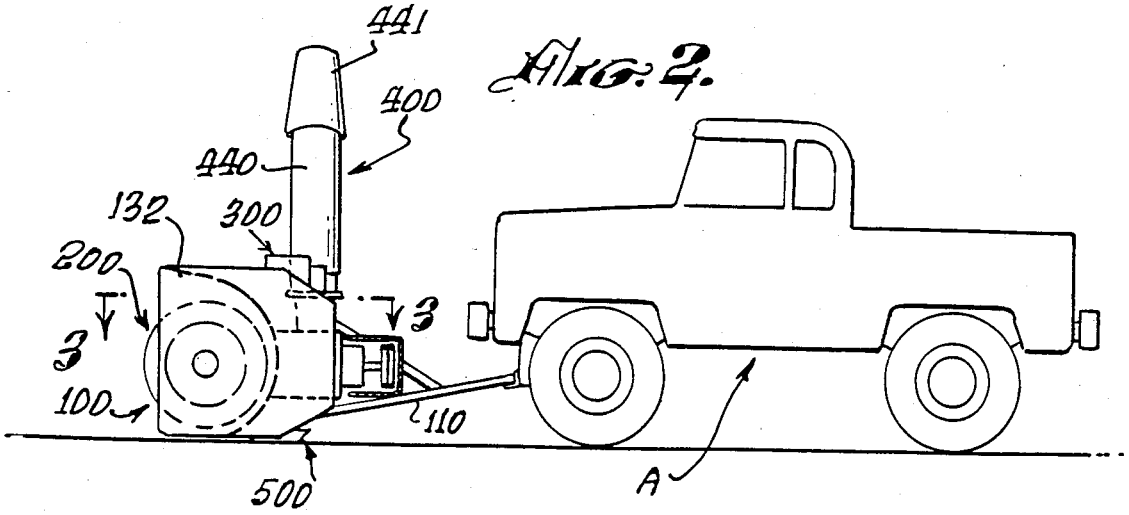
FIG. 2 is a side elevation of the apparatus shown in FIG. 1, in reduced scale.

Viewing FIGS. 1 and 2 together it will be most easily understood that the apparatus 100 is connected to the vehicle A by appropriate frame work 110 or the like which is described in further detail, but which will also be understood by those skilled in the art.

The double spiral element generally 200 consists of an auger 204, appropriately fastened by welding or the like to shaft 201, with another auger spiraling in the opposite direction 205, also fastened to the same shaft 201 as indicated. The two augers thus will carry the snow toward the center position. When the snow reaches this position it will be picked up by the snow paddle device 450 and thrown upward eventually being discharged through the snow discharge arrangement 430 and 440. A blade 120 having a curvature as indicated and being contained within ends 132 and 131 will of course hold the snow and force it into the spiraling augers for its ultimate removal as set forth. Appropriate bearings or the like 102 and 103 (shown in FIG. 3) will be utilized to mount the shaft 201 on appropriately journaled devices 202 or the like.

The engine generally 300 will also be carried on the frame and will drive the shaft 201 by means of appropriate chain 223 or the like, as will be understood by those skilled in the art.

The opening 121 in the shield 122 is provided to accommodate the snow removal mechanism 450.

Figure 3:
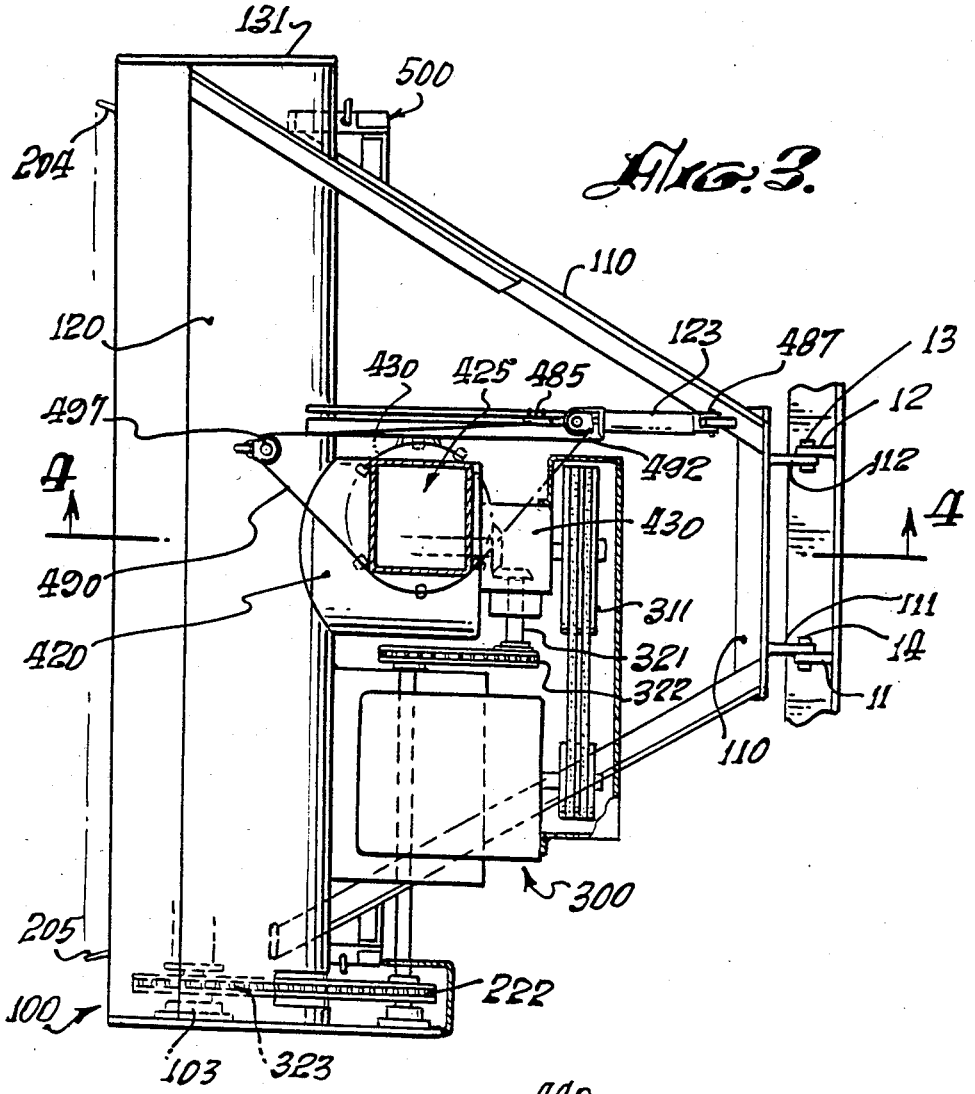
FIG. 3 is a top elevational view of the apparatus of FIG. 1 without a view of the automotive vehicle and with certain elements removed for clearer understanding.

FIG. 3 illustrates the framework 110 in more detail it being understood that this frame can be formed of angle iron, channel iron, or the like appropriately welded as will be understood by those skilled in the art and having connecting levers 111 and 112 appropriately hinged at 13 and 14 to connecting positions 11 and 12 fastened to the truck or other vehicle (not shown).

The chain 223 is driven by sprocket 222 which is carried on an appropriate shaft or the like and powered by the engine 300 in a manner known to those skilled in the art. There will be appropriate shafts as shown directly and in phantom, together with drive mechanism 322 from output shaft 321 from gear box or the like as may be appropriate.

The engine itself drives the overall mechanism through appropriate belts and pulleys 311, as will be understood by those skilled in the art. A guard (unnumbered) will probably be supplied in most cases for safety purposes.

Figure 8:
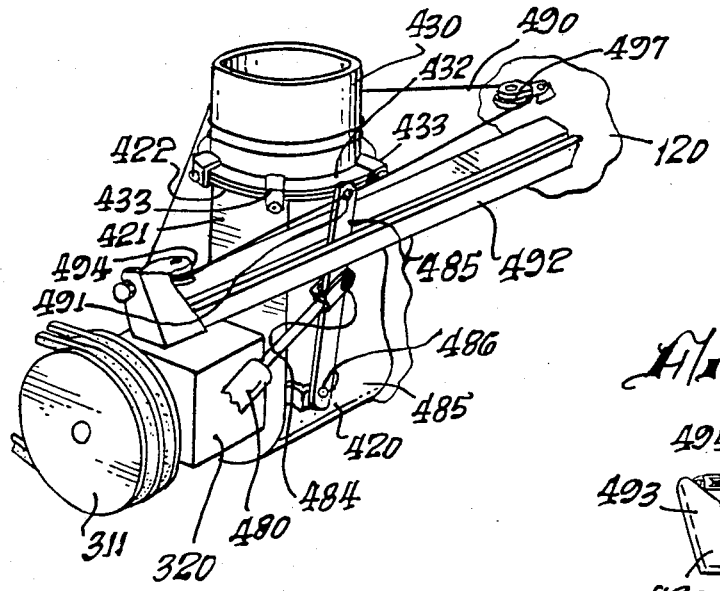
FIGS. 8 and 9 are partial, schematic, perspective views of the mechanism by which snow is diverted when thrown out by this mechanism in operation.
Figure 9:
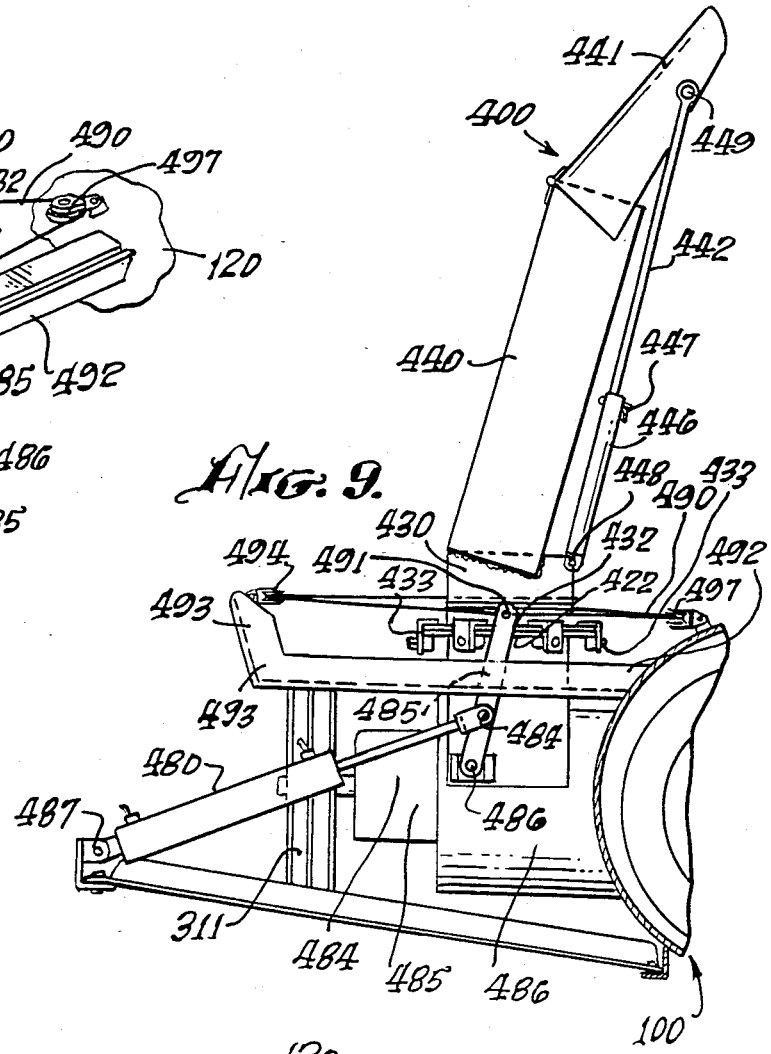
Figure 10:
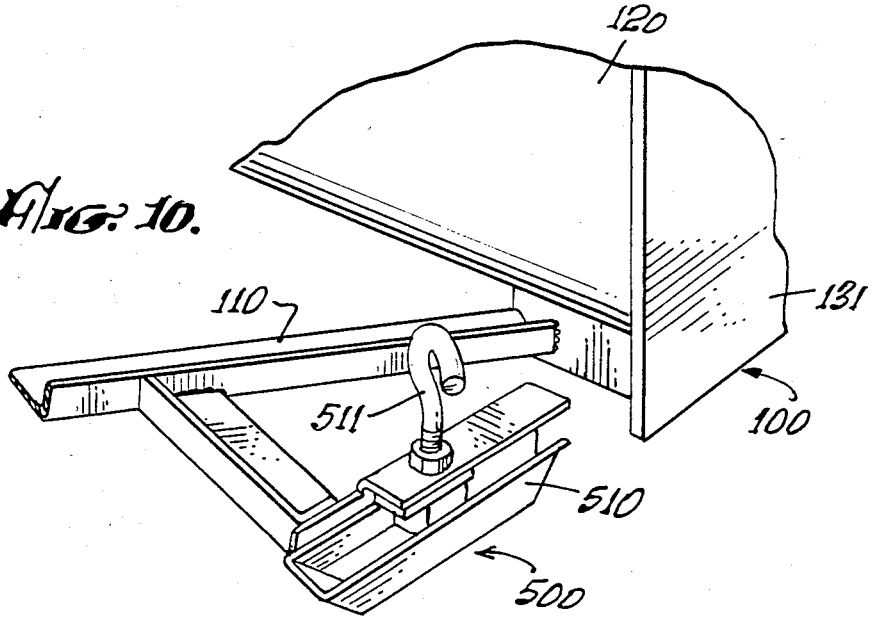
FIG. 10 is a partial schematic perspective of a leveling shoe or skid utilized to stabilize this apparatus.

A mechanism which will be better understood when examining FIGS. 8 and 9 is provided for turning the snow removal chute and this mechanism shows certain elements 490, 497, and 492 in the views presently being studied. The snow removal tunnel 420 is noted to be interconnected to a removal chute 421 having a square inner chute 425 with an upper flange 422 for joinder to the portion 440.

The element 487 is a portion of the turning mechanism for the snow removal chute 440.

Figure 4:
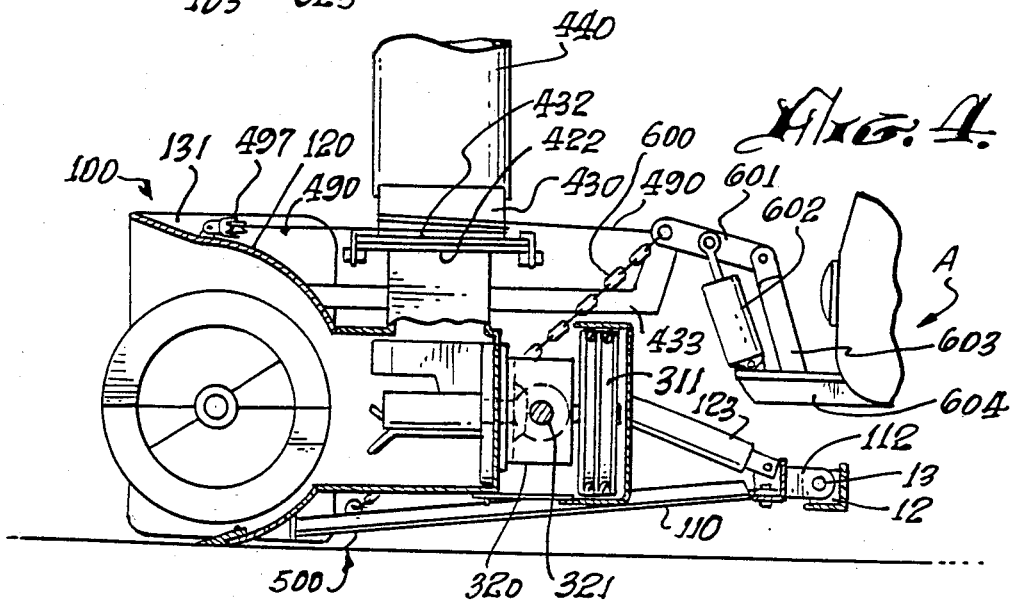
FIG. 4 is a section on 4—4 of FIG. 3 with certain elements added to show the lead portion of a vehicle and with certain elements eliminated for lack of confusion.

FIG. 4 shows the assembly illustrating certain elements already described but additionally showinr well the interconnection of a cable 490 about the circular snow removal portion of the chute 430 and showing the flanges 432 and 422 which will turn as is shown in greater detail in FIGS. 11, 12, and 13 below.

Figure 5:
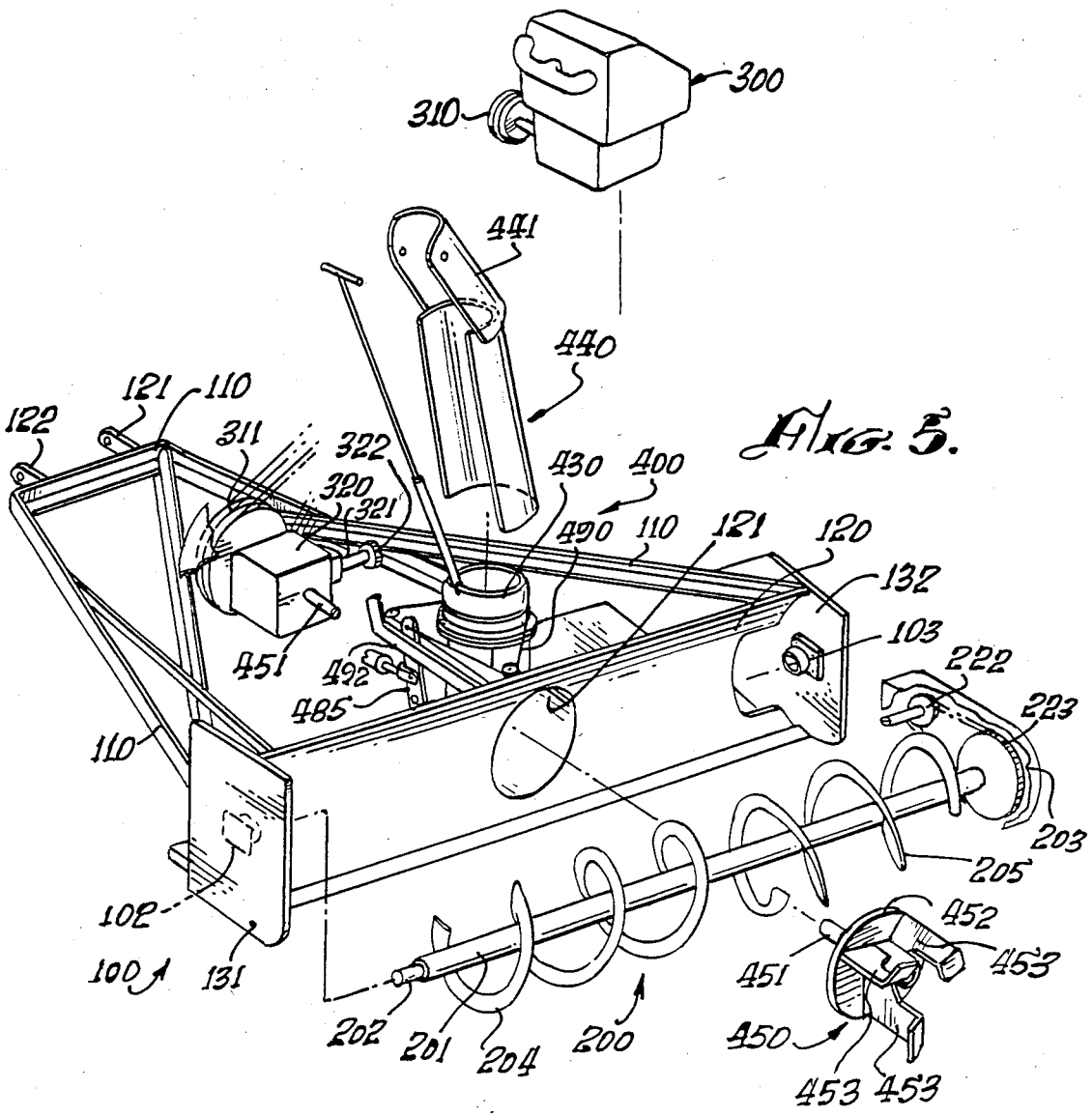
FIG. 5 is a partially exploded schematic view of the elements of the apparatus of this invention without a view of the vehicle which carries it.
Figure 6:
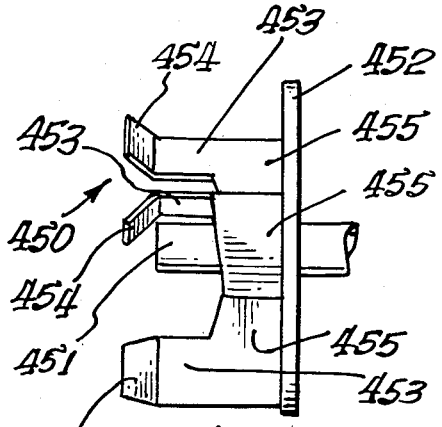
FIG. 6 is an enlarged side elevational view of the apparatus 450 of FIG. 5.
Figure 7:
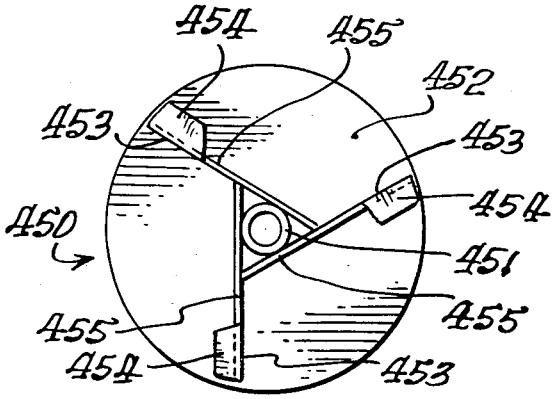
FIG. 7 is a front elevation of the apparatus of FIG. 6.

FIG. 5 is a partially exploded view showing certain of the various elements which have already been described and in addition giving a general overview of the assembly of the unit. Of particular importance is the configuration of the snow paddle device 450 which is further shown in detail in FIGS. 6 and 7. It will be noted that the paddles 453 are so configured and fastened about shaft 451 as to give maximum throwing power. These paddles throw the snow within the opening 121 and the snow tunnel 420. The snow is thrown upward through the square opening 425 from which position it then enters the round snow removal chute 430 and on into the directional portion 440 and 441 for ultimate disposal in the operation of the device.

The paddles 453 are welded or otherwise suitably attached as shown about the shaft and to each other on the back side of each of the main webbings 455. The angled portions 454 cause the snow to be appropriately thrown for removal. The back plate 452, prevents the snow from merely slipping off of the back of the paddles 453. The shaft 451 is of course connected to the drive 320.

FIGS. 8 and 9 show in more detail the unique method by which the snow may be directed from a position remote from the mechanism in order that it may be thrown to the desired area. The cable 490 is fastened to two pulleys 494 and 497 appropriately fastened to the blade 120 at one position and by the brace 492 to the drive box 320. The lever arm 485 is pivoted by connection to a frame element 420 at position 486. Hydralic cylinder 480 appropriately fastened to the frame at 487 as shown is connected to the arm 485 at connecting point 484. The arm 485 is further connected by bolt or the like at 491 to the cable 490. The flanges 422 and 432 pivot upon each other (in a manner which will be most understood when examined in connection with FIGS. 11 and 12).

Thus, by extending or retracting the hydralic cylinder rod, arm 485 is moved and the cable 490, being wrapped around the rotating portion of the snow removal chute causes it to rotate thus directionally aligning the chute 440–441 as may be required. A brace mechanism 445 comprises a rod which telescopes within tubing 446 and is fastened therein by a bolt or the like 447 to appropriate holes as may be desired. The tubing 446 is pivotally connected at 448 as is shown and is pivotally connected at 449 as shown in order to allow appropriate tilting and directional alignment of the hinged portion 441 of the removal chute.

It will be noted that the entire snow removal mechanism is appropriately connected to the vehicle (see (FIG. 4) by a chain 600 for lifting or the like through the arms 601 and 603 being activated by hydralic cylinder 602 in a manner known to those skilled in the art. These elements will be mounted on element 404 connected to the vehicle A.

FIGS. 11, 12 and 13 clearly illustrate the manner in which the two flanges 432 and 422 fit together and are held together through the brackets 433 with rollers 434 fastened by threaded end 435 and nut 436. These rollers when assembled as shown allow the two flanges to freely rotate with relation to one another. The lower flange 422 is actually fixed on the square snow conduit 421 while the upper flange is the one which rotates by means of the cable arrangement heretofore described.

FIGS. 14 and 15 show an alternate embodiment of the snow throwing apparatus previously indicated as element 450. In this case for clarity the apparatus will be referred to as 950 and similar elements will be shown by corresponding numbers. It will be noticed that the principal change is the addition of additional bracing and snow removal element 956 and 957. This alternate can be used effectively and frequently is more effective in removing the snow than the element 450 as previously described.

FIGS. 16 and 17 show a unique clutch and brake arrangement which have been devised to control the output from the independent engine.

The engine has its output pulley 310, and the pulley 311 driven by belts 312 powers the apparatus of this invention. For a clutch, the pulley 890 is pulled by cable 831 connected through pulley 830 appropriately fastened to the frame 110 or the like known to those skilled in the art. The cable 831 is attached at 832 to the handle 812 which is further connected to the lever 814 and pivotally connected to the engine mounting at 813. When the lever is in the upward position as shown, the pulley 890 puts tension on the belt 312 and thus causes the pulley 310 to drive the pulley 311. This is known and understood by those skilled in the art.

The unusual item involved here is that there is another pulley 810 appropriately connected to the frame work or the like and a cable 811 attached to a different position 820 on the lever arm 814. When the pulley is activated in the upward position as shown in FIG. 16, the arm 854 is pulled downward by the cable 811. The spring 843 normally holds the arm 854 in such manner that the brake shoe 852 presses against the pulley 311. The arm 854 is pivotally connected at 851 and thus accomplishes this mechanical transfer of energy.

Once the pressure from the cable 811 is released, which occurs at the same time that the idle pulley 890 is released thus disengaging the clutch effect, the brake shoe 850 presses against the pulley 311 and this completely stops the motion therefore for safety purposes.

Particular attention should be directed to certain of the most important features of this apparatus.

As is clearly shown in FIGS. 11 and 12, the diagonal direction from corner to corner of the square opening 425 is no greater than the inner diameter of the circular chute or conduit 430. Thus, the snow coming through the square opening of these dimensions never clogs in the conduit 430 or beyond. Of great importance also shown in these same figures is the fact that the opening 425 occupies less than a 90° quadrant of the snow tunnel 420.

Additionally, it should be observed that the shoe generally 500 is so positioned that it can be adjusted with lifting hook 511 and it can be adjusted to provide any desired protective clearance from the surface from which the snow is being cleared. The shoe comprises generally a channel shaped element 510 positioned approximately as shown with relation to the blade 120 and the end at 131. A like arrangement will exist on the other side.

The braking arrangement for the pulley as previously described in connection with FIGS. 16 and 17 is also a unique independent sub-invention.

It will be understood by those skilled in the art that the hydraulic power for the hydraulic cylinders illustrated can be provided by utilization of the power of separate engine or could be independently powered to a separate hydralic unit, or could be powered from the automotive vehicle. It is understood that the cylinders would be double acting cylinders and that the appropriate hoses and valve controls could either be exterior of or located within the driving compartment of the vehicle. These particular items are expedience only. The various inventive features have been distinctly set forth and although certain of these items may be expedience it is believed that this overall concept is also a distinct invention in its self giving rise to a distinct new combination of elements all working in conjunction with one another to achieve a new and unique and very useful result.

While the apparatus is shown and described it is fully capable of achieving the objects and advantages desired, it is to be ubderstood that this embodiment has been shown for purposes of illustration only and not for purposes of limitation.

I claim:

1. In combination with a light automotive vehicle, a snow removing apparatus comprising: a frame work mounted upon said automotive vehicle; an engine with power output means carried by said frame work; a first snow removal device comprising a spiraling auger carried upon a shaft connected to said power output means in such manner that the power output means will impart rotary movement thereto; a second snow removal device independently powered by said power output means located proximate the center of the first snow removal device, so positioned as to receive snow from the first snow removal device and dierected in a direction perpendicular to which snow was being was being removed by the first snow removal device; clutch means interposed between the power output means and the two snow removal devices; brake means cooperatively connected to the clutch means so that when the clutch means is disengaged the brake means will apply braking force to both snow removal devices; a snow directional chute so positioned as to receive snow from the second snow removal device and direct the snow to a desired position; and means to intermittently activate or deactivate the apparatus as may be desired.

* * * * *